United States Patent [19]

Cohn

[11] 4,053,048

[45] Oct. 11, 1977

[54] MATCHBOOKS

[76] Inventor: Charles C. Cohn, Colonial Alloys Company, 4041 Ridge Ave. - Bldg. No. 11, Philadelphia, Pa. 19129

[21] Appl. No.: 692,854

[22] Filed: June 4, 1976

[51] Int. Cl.[2] ..... A24F 27/00

[52] U.S. Cl. ..... 206/106; 35/8 R; 206/112; 206/457

[58] Field of Search ..... 35/8 R; 40/359; 131/170 R, 185, 234, 249; 206/104, 106, 108-109, 457, 459

[56] References Cited

U.S. PATENT DOCUMENTS

| | | | |
|---|---|---|---|
| 2,935,185 | 5/1960 | Will | 206/108 |
| 3,939,970 | 2/1976 | Schoenberger | 206/457 X |
| 3,958,689 | 5/1976 | Roth | 206/106 X |

*Primary Examiner*—Steven E. Lipman

*Attorney, Agent, or Firm*—Smith, Harding, Earley & Follmer

[57] ABSTRACT

The striking surface of a matchbook is camouflaged, protected or concealed to reduce the probability of the successful striking of a match by young children.

4 Claims, 11 Drawing Figures

MATCHBOOKS

BRIEF SUMMARY OF THE INVENTION

This invention relates to matchbooks, and is directed particularly to improving the safety of matchbooks in the hands of young children.

Substantially all matchbooks presently in use take one or the other of two forms. Some have a striking surface, or friction, located on the front of the matchbook, on the flap retainer. This form of matchbook has been in use for years, and is still in use. More recently, the trend has been to position the striking surface on the rear of the matchbook cover. The positioning of the striking surface on the rear of the cover has resulted in a significant improvement in safety by reducing the likelihood of accidental ignition of the matches remaining in the book when a match is struck. However, very young children are able to ignite matches easily with either form of book, and these matchbooks therefore represent a serious hazard.

Numerous different forms of matchbooks directed toward improvements in safety have been proposed and patented. Most of these are concerned primarily with the prevention of accidental ignition of the matches remaining in the matchbook. Some of the proposed matchbooks have features which may discourage or even prevent a child from igniting a single match. However, none of these proposals has met with any substantial degree of success.

The many proposed matchbooks have not been successful, principally because they are structurally complicated and difficult to manufacture, and because their manufacture would require expensive modifications to, or replacement of, presently existing machinery.

The principal object of this invention is to provide a matchbook which substantially reduces the likelihood of match ignition by a young child, and which is nevertheless simple in construction, easily and inexpensively manufactured, and usable by an adult without difficulty.

The key to the successful accomplishment of these objectives lies in the use of camouflage, protection or concealment techniques, which have not been used heretofore in connection with safety improvements either in matchbooks or in analogous arts. Thus, each embodiment of the invention described herein is characterized by means for camouflaging, protecting or concealing the striking surface of a matchbook. It is not the intent of the invention to eliminate absolutely the possibility of successful ignition of a match by a child; rather the approach is that of substantially reducing the probability of successful ignition by a child. Matchbooks constructed in accordance with the invention are much safer than the two forms of matchbook which presently dominate the market.

DETAILED DESCRIPTION

Figure 1:
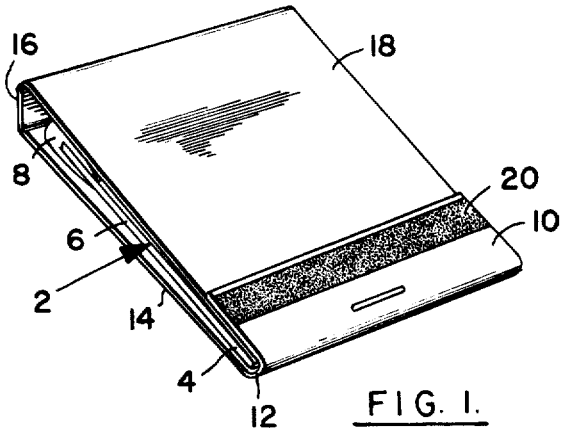
FIG. 1 is a perspective view, showing the front side of a matchbook having a camouflaged striking surface and constituting a first embodiment of the invention.
Figure 2:
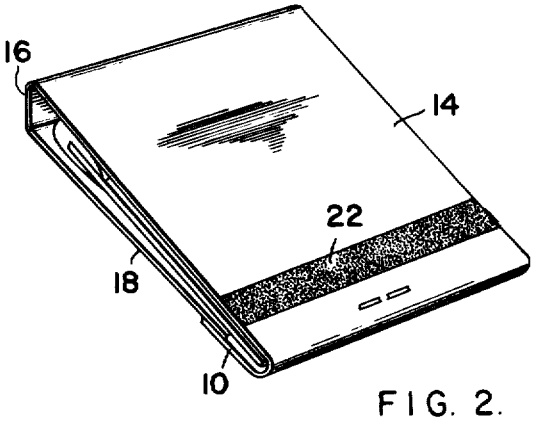
FIG. 2 is a perspective view, showing the opposite side of the matchbook of FIG. 1.

Referring to FIGS. 1 and 2, a matchbook is shown comprising a comb of matches, generally indicated at 2, the comb having a base 4, and a plurality of match stems extending therefrom, and exemplified by stem 6. Each such stem is provided with a match head, such as head 8, at its end remote from the base. A matchbook cover, designed to provide substantially a complete closure for said matches except at the narrow sides of the comb, comprises a unitary strip of cardboard appropriately folded to provide a flap retainer portion 10 overlying base 4, a first fold 12 forming a pocket for receiving base 4 of the comb, a back portion 14 extending from fold 12 to the vicinity of the heads, a second fold 16 forming a pocket for receiving the heads of the matches in the comb and a flap portion 18 extending from fold 16, along the stems of the matches, and underneath flap retainer portion 10 so that it is held in the pocket formed by retainer 10, between the retainer and the base of the comb.

In the embodiment of the invention shown in FIGS. 1 and 2, the striking surface is camouflaged by providing two identically-appearing strips 20 and 22, the first being located, as shown, on flap retainer 10, and the second being located on the back portion 14, preferably directly opposite strip 20. Only one of strips 20 and 22 is a real striking surface; the other is a decoy. Preferably, the effective striking surface is strip 22 on the rear of the matchbook, and the decoy is strip 20 on the front. A young child who has removed a match from the matchbook, is more likely to attempt to strike it on surface 20 than on surface 22. The composition of surface 20, however, while appearing to be a true matchbook friction, is substantially ineffective for igniting a conventional safety match.

A conventional matchbook friction typically comprises an abrasive, such as emery, aluminum oxide or fine sand, together with a quantity of red phosphorous and a binder. This is the composition of surface 22. Excellent results in terms of appearance and ineffectiveness of surface 20 are obtained by eliminating the red phosphorous and utilizing abrasive and binder for surface 20.

One example of a suitable composition for surface 20 is the following:

53.88 percent of type "0" sodium silicate solution (binder);
29.12 percent water;
4.85 percent hydrated alumina (abrasive);
12.15 percent black dye (coloring matter).

Type "0" sodium silicate is available from Philadelphia Quartz Company, and consists of 29.5 percent $SiO_2$, 9.15 percent $Na_2O$ and 61.35 percent water. One example of a suitable black dye is "Buffalo Black NBR concentrate, 126%" available from National Aniline Company.

Although not necessary in many cases, a small quantity of iron oxide ($Fe_2O_3$) or other coloring material may be added to the foregoing ingredients to impart a red tint to surface 20 resembling that resulting from the presence of phosphorous. An attempt to strike a safety match on surface 20 will normally be unsuccessful, unless the striking action is so vigorous as to generate a great deal of heat.

Alternative compositions can be used for the ineffective striking surface 20. For example, a surface closely resembling an ordinary striking surface can be made from the following composition:

23.53 percent ferric oxide ($Fe_2O_3$) (coloring matter);
5.88 percent densed activated carbon (coloring matter);
23.53 percent water;
47.06 percent type "O" sodium silicate (binder).

A suitable densed activated carbon is "raven 30 densed", available from Citgo Oil Company of Tulsa, Oklahoma. The above composition very closely resembles an effective striking surface.

As an alternative to the above compositions, surface 20 can be printed on a matchbook cover, using a dark brown ink in the same step in which advertising or decorating matter is printed on the cover. As a further alternative, surface 20 can be a colored paper strip glued to the matchbook cover. Any one of these alternatives will provide an ineffective striking surface, the presence of which at the location shown in FIG. 1 will greatly reduce the probability of the successful striking of a match on effective surface 22 by a young child.

Figure 3:
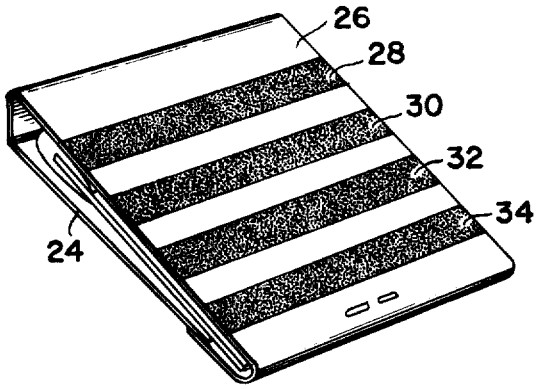
FIG. 3 is a perspective view of a matchbook having a camouflaged striking surface and constituting a second embodiment of the invention.

A similar reduction in the probability of the effective striking of a match by children can be achieved by the use of multiple strips on one side of the matchbook, as shown in FIG. 3. A matchbook cover 24 is provided on its rear side 26 with a plurality of strips 28, 30, 32 and 34. Only one of these is an effective friction, the others being similar to surface 20 of FIG. 1, and ineffective for striking purposes. Preferably, at least four strips are provided. Only one, for example strip 32, is the effective one. The effective strip can be identified by appropriate printed matter on the matchbook cover, which would not be readable by a young child. In the embodiment of FIG. 3, it is particularly important that the strips closely resemble each other, and therefore it is preferred that the ineffective strip 32 be formed from the same composition as the effective strips except for the omission of red phosphorous. A small quantity of iron oxide or other coloring matter is desirably used in the composition of strip 32 to match the coloring of the remaining strips 28, 30 and 34.

Figure 4:
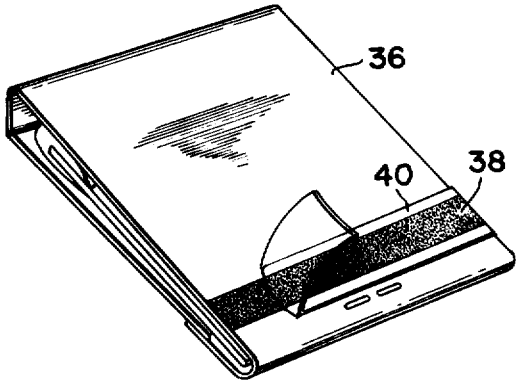
FIG. 4 is a perspective view of a matchbook constituting a third embodiment of the invention, wherein the striking surface is protected by a transparent adhesive tape.

A form of protection of the effective striking surface of a matchbook is illustrated by FIG. 4, wherein the rear side of the cover of matchbook 36 is provided with a striking surface at the usual location, covered by a strip 40 of transparent adhesive tape. The strip of adhesive tape normally extends over the entire length of surface 38, but can be pulled back, as shown, to expose the striking surface. When the strip of adhesive tape is in place over the striking surface, the striking surface is clearly visible through the tape. With presently available plastic tape, the striking surface, as viewed through the tape, appears very little different from an exposed striking surface. For this reason, it is not apparent to young children that the tape must be removed before striking a match, and the probability of the successful ignition of a match by a child is accordingly reduced. The adhesive tape need not be completely coated on one side with adhesive; adhesive edges or margins, for example, are sufficient to cause the tape to adhere to the matchbook cover.

Figure 5:
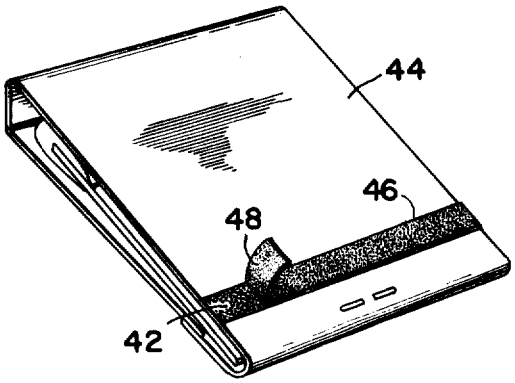
FIG. 5 is a perspective view of a matchbook constituting a fourth embodiment of the invention, wherein the striking surface is camouflaged by an adhesive tape having an outside surface having an appearance substantially similar to that of an effective striking surface.

Adhesive tape can also be used for camouflaging the striking surface of a matchbook as illustrated in FIG. 5. An effective striking surface 42, located in the usual position on the rear side of the cover of matchbook 44 is covered by a strip 46 of paper tape having an adhesive 48 on one side thereof for securing the tape against striking surface 42. Preferably, the width of tape 46 is substantially the same as that of the usual striking surface. The outer surface of the tape is colored with a brown ink so that it has an appearance substantially similar to that of an effective striking surface. With tape strip 46 in place, young children are unlikely to observe that it must be pulled back to expose the effective striking surface surface 42 before a match can be successfully ignited.

Figure 6:
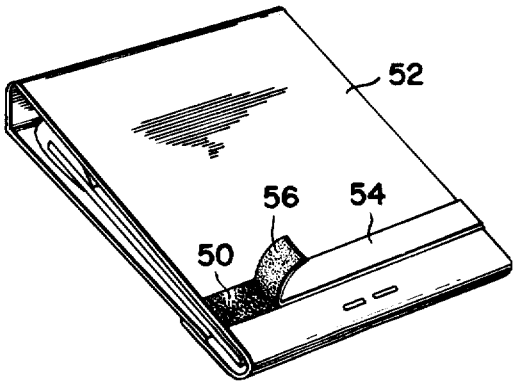
FIG. 6 is a perspective view of a matchbook constituting a fifth embodiment of the invention, wherein the striking surface is concealed by an adhesive tape, the outside surface of which bears a pattern substantially similar to that of the remainder of the matchbook cover.

A strip of adhesive tape can also be used to conceal a striking surface as illustrated in FIG. 6. Striking surface 50, which is placed in the usual location on the rear side of the cover of matchbook 52 is covered by a strip 54, having an adhesive surface 56 for securing it in overlying relationship to the striking surface 50. The outer surface of tape 54 bears a pattern similar to that of the matchbook cover, so that it cannot be readily distinguished from the matchbook cover by a child. Thus, if the matchbook has a plain white cover, a plain white strip of adhesive tape is used to cover the striking surface. If the cover has a pattern of colored lines, for example, the tape 54 should also have a similar pattern of colored lines.

Figure 7:
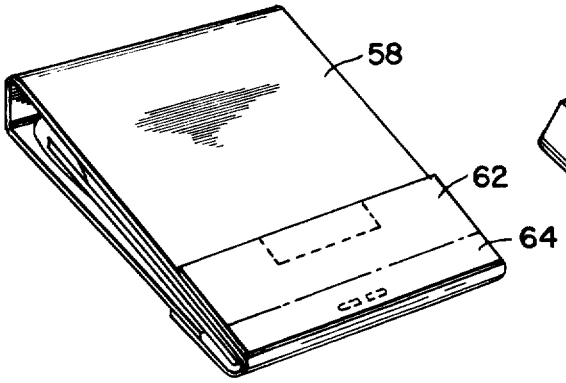
FIG. 7 is a perspective view of a matchbook constituting a sixth embodiment of the invention, having an opaque flap for concealing the striking surface.
Figure 8:
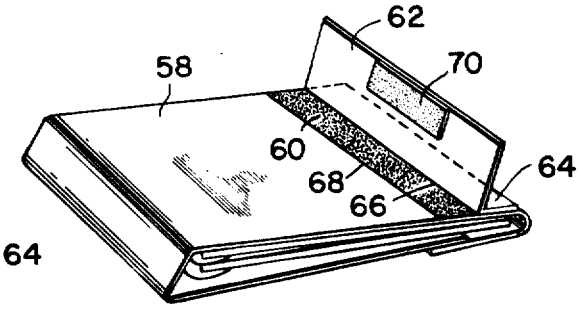
FIG. 8 is a perspective view of the same matchbook as shown in FIG. 7, but showing the opaque flap in an opened condition.

FIGS. 7 and 8 illustrate a means of concealing a striking surface by means of an opaque flap. Again, a matchbook 58 is provided with a conventional striking surface 60, located in the usual position on the rear side of the matchbook cover. A cardboard flap 62 is secured by means of an adhesive strip underneath portion 64 of the flap along a line 66 which is parallel to edge 68 of striking surface 60.

As illustrated in FIG. 8, the flap 62 opens to expose striking surface 60, the cardboard forming a hinge along line 66. A rectangular element 70 of adhesive material is provided on the underside of flap 62 in order to hold the flap securely against the outside of the matchbook cover when it is closed. The rectangular adhesive element 70 is preferably positioned as shown in FIG. 8 so that it comes in contact with the matchbook cover, but not with the striking surface 60. Adhesive element 70 permits the flap to be opened and closed repeatedly, with the flap held tightly against the striking surface and matchbook cover when closed. Otherwise, the deformation at line 66 would tend to hold the flap in a partially open condition, thus defeating the purpose of the flap.

Figure 9:
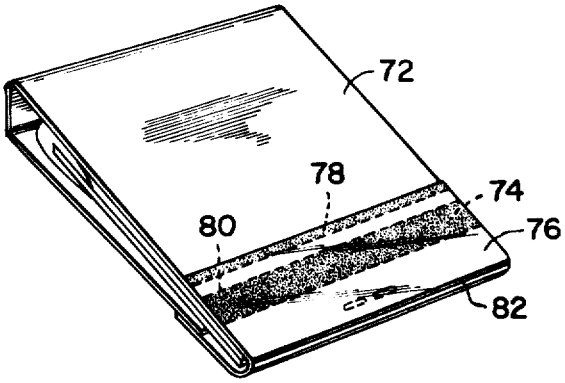
FIG. 9 is a perspective view of a matchbook constituting a seventh embodiment of the invention, wherein the striking surface of the matchbook is protected by a transparent flexible plastic strip.

FIG. 9 shows a matchbook having a cover 72, with a striking surface 74 in the usual location on the back of the matchbook. Striking surface 74 is protected by a transparent covering means 76, which is secured to the matchbook cover 72 by a narrow strip 78 of adhesive, disposed along a line parallel to edge 80 of the striking surface. Covering means 76 normally lies flat against the striking surface, as shown. The transparent cover is preferably cut from a sheet of deformable, resilient plastic material such as polyethylene. In order to strike a match, edge 82 is lifted, and the match is struck in the usual manner. Because of its resilience, the transparent plastic cover returns to the position shown when it is let go. Young children are able to see the striking surface through the plastic cover, and are unlikely to observe that the plastic cover must be lifted before a match can be successfully ignited. Accordingly, the matchbook construction shown in FIG. 9 reduces the probability of the successful striking of a match on the striking surface by a young child.

Figure 10:
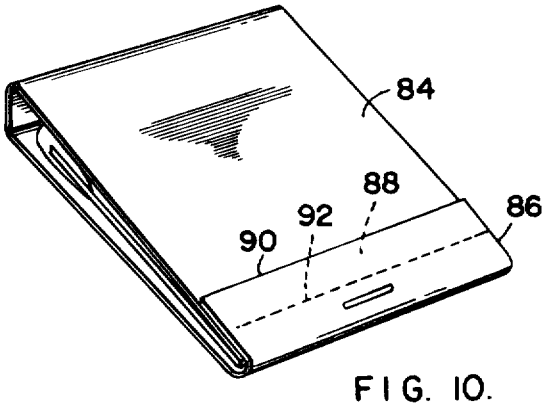
FIG. 10 is a perspective view of a matchbook constituting an eighth embodiment of the invention, wherein the striking surface is concealed from view.

Another way to conceal the effective striking surface of a matchbook from a young child is illustrated by FIG. 10, in which a matchbook is shown having a front flap 84 held under retainer 86 in the usual fashion. The effective striking surface is located on the underside of flap retainer 86, and is indicated at 88, the boundaries of the striking surface being along lines 90 and 92.

A match is ignited by placing its head underneath retainer 86, between the striking surface 88 and flap 84, and pulling the stem of the match in a direction parallel to the length of striking surface 88 the match head will be ignited as it emerges from underneath the retainer. The striking surface can be located in several alternative positions, for example on the interior of the front flap, along the edge which fits underneath retainer 86, or even on the base of the comb.

The striking surface 88, being located on the interior of the cover, and within the pocket formed by the retainer and the rear panel of the matchbook, is well hidden from young children. As a further precaution, an ineffective striking surface can be applied to the outside of retainer 86, or to the opposite side of the matchbook, or at both locations.

Figure 11:
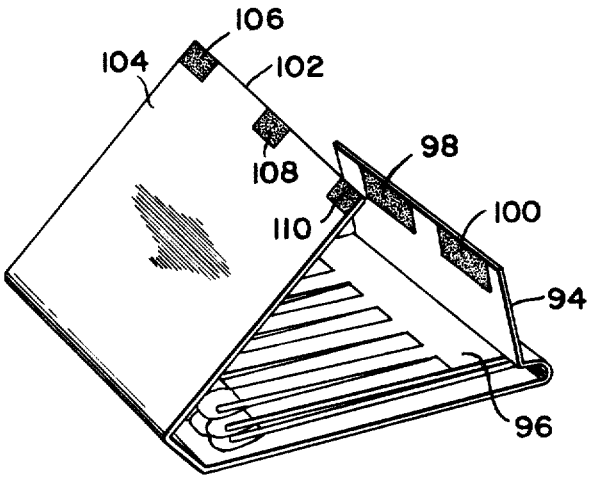
FIG. 11 is a perspective view of a matchbook constituting a ninth embodiment of the invention, wherein the striking surface consists of two interlocking segmented parts, both concealed from view.

The matchbook shown in FIG. 11 has a concealed striking surface which is quite difficult for a child to use. This matchbook is also safer in the hands of adults, since its cover must be closed before a match can be struck without great difficulty.

In FIG. 11, flap retainer 94 is shown pulled away from the base 96 of the match comb for illustrative purposes only. Inside retainer 94 are two separate effective striking surface sections 98 and 100. End 102 of flap 104 is provided on its outside with three effective striking surface sections 106, 108 and 110. The five striking surface sections shown are arranged so that they interlock when the matchbook is closed to provide a substantially continuous contact with a match pulled between retainer 94 and flap 104. This allows a match to be ignited easily when the matchbook is closed. The striking surface sections, however, are individually very short, being preferably less than approximately ½ inch in length, so that it is quite difficult to strike a match on any individual striking surface section, or on any combination of striking surface sections on the flap alone or on the retainer alone. Desirably, the striking surface sections 106, 108 and 110, on the flap, are shorter than the striking surface sections 98 and 100 on the inside of the retainer, since the striking surface sections on the flap are the ones which a child is most likely to attempt to use.

The number of striking surface sections on the flap and on the retainer may vary, and it is possible to provide only one striking surface section on the flap, and only one on the retainer. However, the best results are obtained when a sufficient number of separate striking surface sections are provided to produce an interlocking relationship, as shown. Again, an ineffective striking surface may be provided on the outside of retainer 94, if desired.

I claim:

1. A matchbook comprising:

a comb of matches having a base, a plurality of stems extending therefrom and a head on each of said stems;

a cover having a first portion overlying said base, a first fold forming a first pocket receiving said base, a back portion extending from said first fold to the vicinity of the heads, a second fold forming a second pocket receiving said heads, and a flap portion extending from said second fold along the stems of said matches and into said first pocket between said first portion and said base;

an elongated effective striking surface disposed on the exterior of said cover; and means for camouflaging said effective striking surface, thereby reducing the probability of the successful striking of a match on said surface by a young child;

characterized by the fact that said effective striking surface is disposed on said back portion of the cover, and also by the fact that said means for camouflaging said effective striking surface comprises an additional elongated surface disposed on said first portion, said additional elongated surface having the appearance of said effective striking surface, but being ineffective to ignite said matches.

2. A matchbook comprising:

a comb of matches having a base, a plurality of stems extending therefrom and a head on each of said stems;

a cover having a first portion overlying said base, a first fold forming a first pocket receiving said base, a back portion extending from said first fold to the vicinity of the heads, a second fold forming a second pocket receiving said heads, and a flap portion extending from said second fold along the stems of said matches and into said first pocket between said first portion and said base;

an elongated effective striking surface disposed on the exterior of said cover; and means for camouflaging said effective striking surface, thereby reducing the probability of the successful striking of a match on said surface by a young child;

characterized by the fact that said means for camouflaging said effective striking surface comprises a plurality of additional elongated surfaces disposed on the exterior of said cover, said additional elongated surfaces having the appearance of said effective striking surface, but being ineffective to ignite said matches.

3. A matchbook comprising:

a comb of matches having a base, a plurality of stems extending therefrom and a head on each of said stems;

a cover having a first portion overlying said base, a first fold forming a first pocket receiving said base, a back portion extending from said first fold to the vicinity of the heads, a second fold forming a second pocket receiving said heads, and a flap portion extending from said second fold along the stems of said matches and into said first pocket between said first portion and said base;

an elongated effective striking surface disposed on the exterior of said cover; and means for camouflaging said effective striking surface, thereby reducing the probability of the successful striking of a match on said surface by a young child;

characterized by the fact that said elongated effective striking surface is disposed on said back portion of the cover, and also by the fact that said means for camouflaging said effective striking surface comprises an additional elongated surface disposed on said first portion of the cover, both the effective striking surface and said additional elongated surface containing abrasive as part of their composition, and having a substantially similar appearance, and wherein only the effective striking surface contains red phosphorous.

4. A matchbook comprising:

a comb of matches having a base, a plurality of stems extending therefrom and a head on each of said stems;

a cover having a first portion overlying said base, a first fold forming a first pocket receiving said base, a back portion extending from said first fold to the vicinity of the heads, a second fold forming a second pocket receiving said heads, and a flap portion extending from said second fold along the stems of said matches and into said first pocket between said first portion and said base;

an elongated effective striking surface disposed on the exterior of said cover; and means for camouflaging said effective striking surface, thereby reducing the probability of the successful striking of a match on said surface by a young child;

characterized by the fact that said means for camouflaging said effective striking surface comprises a plurality of additional elongated surfaces disposed on the exterior of said cover, and also by the fact that all of said elongated surfaces, including said effective striking surface have a substantially similar appearance, and are composed of an abrasive material, but only said effective striking surface includes red phosphorous as part of its composition.

* * * * *